United States Patent [19]

Emmerich

[11] 4,175,757

[45] Nov. 27, 1979

[54] SEALANT SYSTEM FOR ROOF DRILLING APPARATUS

[75] Inventor: Kenneth C. Emmerich, Lexington, Ky.

[73] Assignee: Fansteel Inc., North Chicago, Ill.

[21] Appl. No.: 806,822

[22] Filed: Jun. 15, 1977

[51] Int. Cl.[2] ..... F16J 15/10

[52] U.S. Cl. ..... 277/212 F; 175/320; 285/332.1

[58] Field of Search ..... 175/320; 285/332.1, 285/332, 334.3; 277/212 F, 212, 180, 188

[56] References Cited

U.S. PATENT DOCUMENTS

| | | | |
|---|---|---|---|
| 2,017,362 | 10/1935 | Werder | 285/332 |
| 2,830,792 | 4/1958 | Sears | 175/320 |
| 3,338,597 | 8/1967 | Mason | 285/334.3 |
| 3,573,871 | 4/1971 | Warner | 277/168 |
| 3,871,937 | 3/1975 | Hollingsead | 277/178 |

FOREIGN PATENT DOCUMENTS

| | | | |
|---|---|---|---|
| 721163 | 12/1954 | United Kingdom | 285/356 |

*Primary Examiner*—Robert I. Smith

*Attorney, Agent, or Firm*—Barnes, Kisselle, Raisch & Choate

[57] ABSTRACT

A sealant system for multiple part drilling components utilizing water as a coolant and flushing medium which includes nipple-like sealing inserts to interfit with axial recesses and with other opposed inserts to seal the axial passages extending through the joined axially aligned parts, each insert having a sealing relation to an axial passage in which it is carried and projecting into an adjacent part to interfit therewith.

2 Claims, 10 Drawing Figures

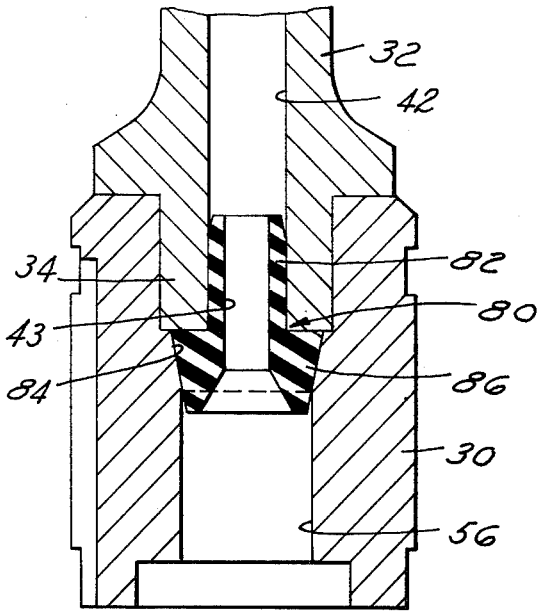
FIG. 5
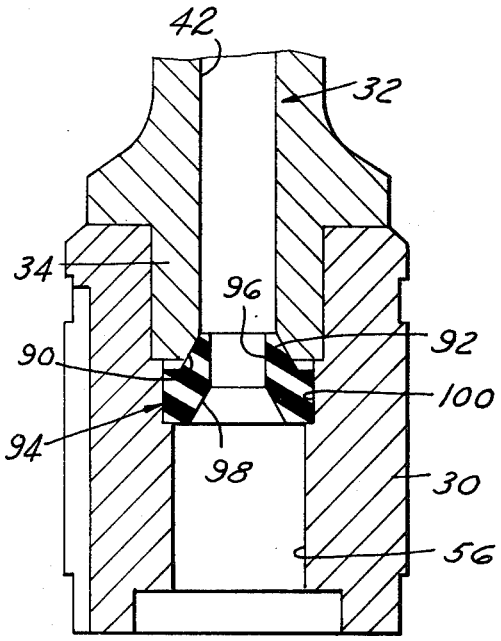
FIG. 6
FIG. 1
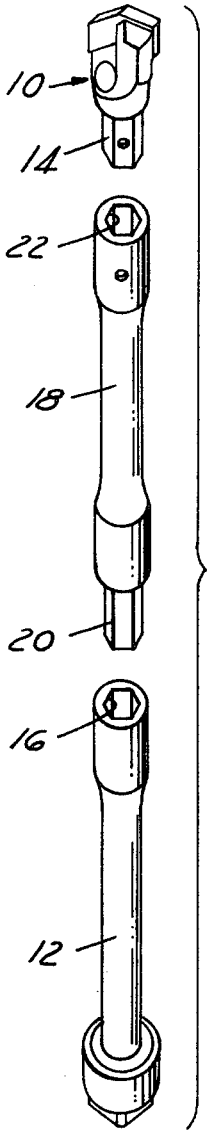

SEALANT SYSTEM FOR ROOF DRILLING APPARATUS

This invention relates to a Sealant System for Roof Drilling Apparatus and more particularly to a structure for use in the mining field in roof drilling, tunnel drilling, rock boring and so on, both as a rotary and a rotary percussion system.

The concept is especially adapted for use in systems which utilize water flushing with a pressure water flushing system.

The present invention contemplates an improved drilling system which can be used for roof drilling in mining areas where the roof areas are to be reinforced by anchor bolting systems, i.e., a system wherein a mechanical expansion and tensioning bolt is inserted in a drilled hole, or by resin bolting wherein a drilled hole is charged with a setting resin and activated by a core bolt which is inserted to mix the resin and provide a core for the resin which sets around it (Mining and Metallurgy, Bulletin No. 776, July 1971). The bit may also be used in drilling charge holes for blasting, for rock boring, highway construction, light post base anchor holes, anchorage railings and the like.

The holes used in mining applications are sometimes quite deep and the drill driver may have several sections of drive shafts linked together before the hole is finished. On the other hand, when the hole is being started, a bit is sometimes driven by what is called a starter element with a driver and additional extensions are then sometimes inserted between the starter and the bit as required for the desired depth of the hole.

Since water is used under pressure to cool the bit and to flush the chips and dust away from the drilling area, it is desirable that the various elements of the drilling apparatus, which have central coolant passages, be joined in a water tight seal. This has the advantage that operators who are guiding the system will be less exposed to uncontrolled water spillage and to the discomfort of wet clothing resulting from the spill-over of the coolant liquid. It also has the advantage that the water will be at full pressure at the bit end and better perform its function of cooling and flushing. In addition, the system is more efficient in that all of the coolant fluid that is furnished to the drilling apparatus is utilized for the purpose for which it is intended.

Other objects and features of the invention will be apparent in the following description and claims in which the principles of the invention are set forth, together with details which will enable a person skilled in the art to practice the invention, all in connection with the best mode presently contemplated for the invention.

Drawings accompany the disclosure and the various views thereof may be briefly described as:

FIG. 1, an exploded view of parts utilized in the drilling apparatus.

Figure 2:
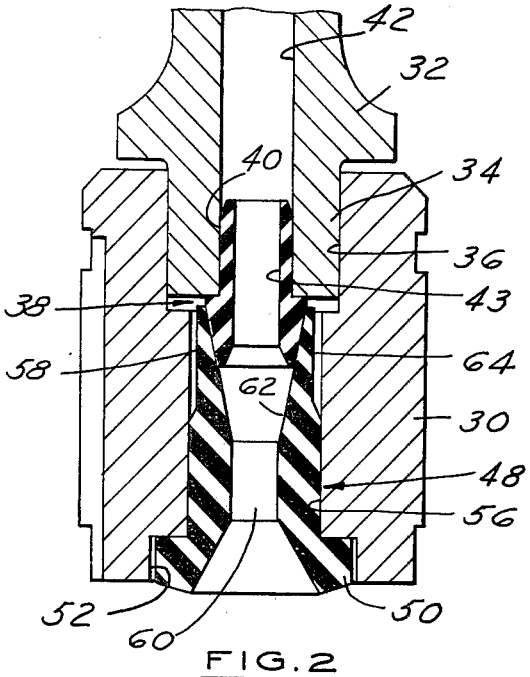

FIG. 2, an assembly view of two of the parts of a drilling apparatus in section illustrating the relationship of the parts.

Figure 3:
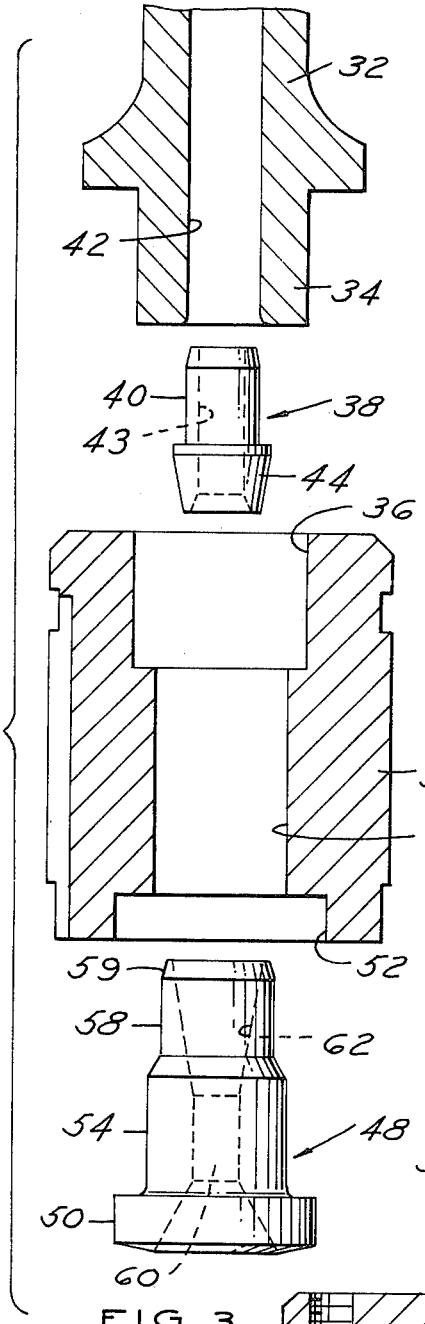

FIG. 3, an exploded view showing the parts of FIG. 2 in non-assembled position.

Figure 4:
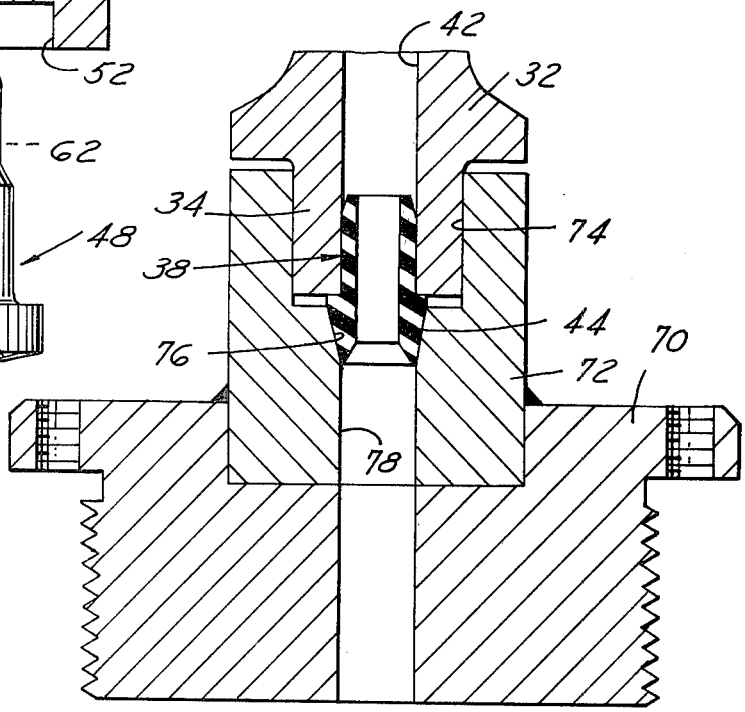

FIG. 4, a modified system utilizing one of the parts of the sealant system in a different apparatus combination.

FIG. 5, a view of a modified part similar to that shown in FIG. 4 for modified structural elements.

FIG. 6, a second sealant insert is a modified construction.

Figure 7:
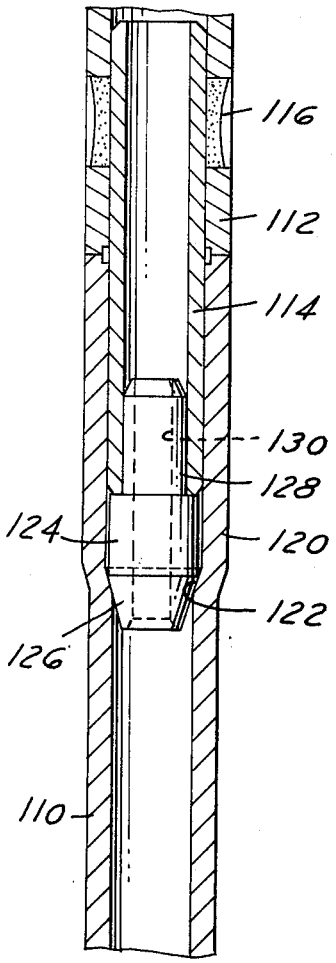

FIG. 7, a modified sealant insert having a longer body shank.

Figure 8:
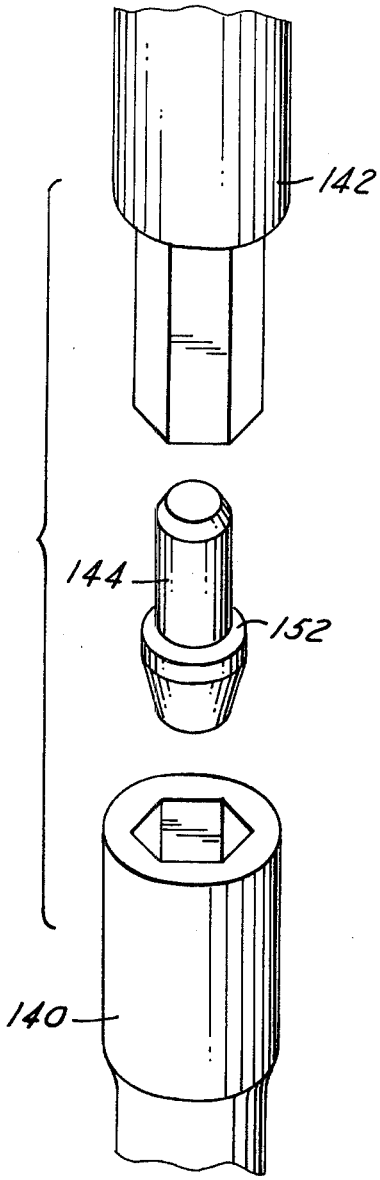

FIG. 8, an exploded view showing a driver and a middle extension and seal.

Figure 9:
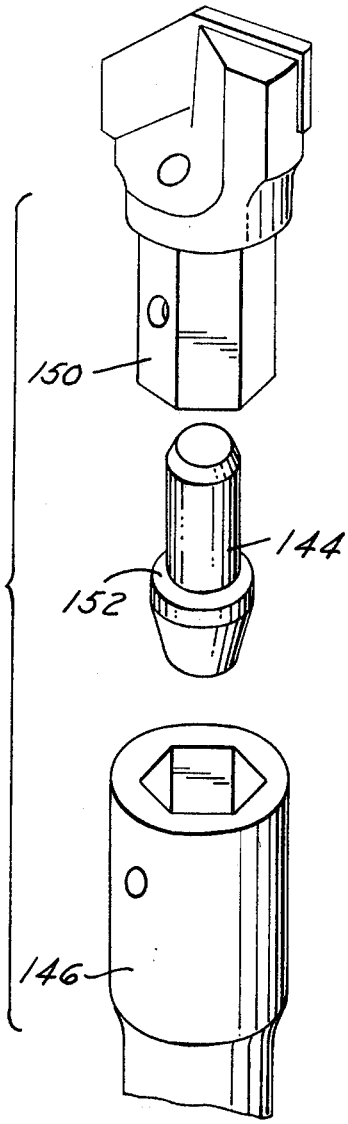

FIG. 9, an exploded view showing a middle extension and bit and seal.

Figure 10:
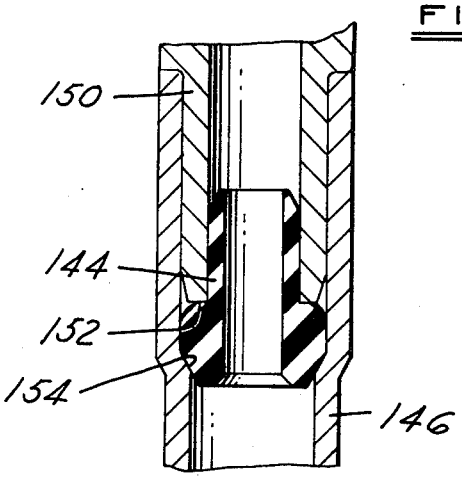

FIG. 10, a sectional assembly of a bit and drive steel.

Referring to the drawings:

In FIG. 1, a drill bit 10 is illustrated and a driver element 12 is shown at the bottom of the figure. The drill bit 10 and the driver element 12 may be telescoped together in driving relationship, the shank 14 of the drill bit interfitting into the hexagonal socket 16 of the driver. A middle extension unit 18 is shown centrally of the drawing, having a shank 20 to interfit with the driver and a recess 22 to interfit with the shank 14 of the drill bit. Additional middle extensions 18 may be utilized if the hole to be drilled is to have a depth greater than the depth of the three elements shown.

FIG. 1 thus illustrates the general type of roof drilling which is utilized in the industry although the parts shown in FIG. 1 are the subject of a patent application of Kenneth C. Emmerich, entitled "Roof Drilling System," filed in the U.S. Patent Office on Jan. 19, 1977, Ser. No. 760,712.

It will be appreciated that different companies utilize slightly different structures as drivers, intermediate elements, and so on, and that it is desirable to provide a sealant element which will adapt to as many structures as possible.

In FIG. 2, a drive socket 30 is interfitted with an adjacent drilling element in the form of a driver unit 32 in a telescoping joint wherein a shank 34 is interfitted into an opening 36. A double seal element is utilized in this system wherein a small nipple 38 has a cylindrical portion 40 which is pressed into the axial recess or opening 42 of element 32 to have a sealing relationship therewith. The nipple has a central passage 43.

An enlarged nose portion 44 (FIG. 3) projects from the central axial recess 42 and has a tapered outer surface. An adjacent element in the form of a second sealing element 48, carried by the part 30, has three diameters, including a flanged end 50 which is received in a recess 52 of the drive socket 30, an intermediate section 54 which is received in a bore 56 of the drive socket 30 in a tight fitting relationship, and a lead end 58 which is slightly smaller than the bore 56 and has a short bevel end 59. The central opening 60 in the element 48 has a conical recess 62 which has an interfitting relationship with the tapered end 44 of the element 38. The parts 38 and 48 are preferably formed of a tough plastic or rubber-like material, either natural or synthetic, with sufficient flexibility and deformability that the part 44 will insert into a complementary recess in the form of the conical recess 62 in a sealing relationship. Good wearing characteristics against abrasion are also required. A recess 64 surrounding the small end 58 in the bore 56 allows sufficient expansion that the parts may be forced together into a sealing contact. The assembly is shown in FIG. 2.

In FIG. 4, the same driver element 32 is connected to another type of an adjacent drilling element in the form of a drive element composed of a collar 70 into which is welded an adaptor 72 having a recess 74 to receive shank 34 of the driver. The sealing element 38 is inserted into the axial recess 42 of the driver in the same manner as in FIG. 2 and in this case, the tapered portion 44 is received in a complementary recess formed by a machined bevel 76 in the coolant passage 78 of the adaptor 72 in the drive socket chuck 70.

In FIG. 5, a slightly modified insert similar to 38 in FIGS. 2, 3, and 4, is shown at 80 having a neck portion 82 to be received in the axial recess 42 of the driver 32. An adjacent drilling element, namely, the drive socket 30, illustrated also in FIGS. 2 and 3 with the central recess 56, has a complementary recess in the form of a short tapered machined portion 84 to receive an enlarged tapered portion 86 on the neck portion 82.

A further modification of the device is illustrated in FIG. 6 wherein the driver element 32 has formed, adjacent the axial recess 42 at the lower end, a tapered recess 90 to receive a tapered projection 92 on a small nipple seal 94 with a central passage 96 which enlarges at 98. An adjacent drilling element, namely, the drive socket 30 is provided with a counterbore 100 to receive a cylindrical portion of the nipple 94 so that there is a seal in this counterbore as well as in the tapered recess 90.

In FIG. 7, a modified sealant insert is illustrated between a driver steel 110 and a middle extension 112. A drive tube insert 114 with appropriate cross-section is welded at 116 to the extension 112 and has an extending portion to fit complementally into the socket end of driver 110 which is enlarged at 120 so that a shoulder is formed internally at 122. The sealant insert has a cylindrical body portion 124 with a tapered end 126 and an ensmalled cylindrical end 128. A hole 130 for coolant extends through the insert. In assembly, the end of tube 114 butts against a shoulder formed between the body 124 and the end 128. This forces the body portion 124 of the insert down and it is dimensioned relative to the driver 110 so that the tapered portion 126 is pressed firmly against the shoulder 122. The parts will be secured by radial plugs or other suitable retention means.

In FIGS. 8, 9 and 10, a modified seal is shown similar to that shown in FIG. 3 at 38. A female socket 140 joins an adjacent drilling element in the form of a middle extension element 142 with an insert 144 interposed. In FIG. 9, a middle extension 146 joins a bit 150 with insert 144 interposed. This latter combination is shown in cross-sectional assembly in FIG. 10. It will be noted that the end of the hexagonal shank 150 will jam against the shoulder 152 of the insert to force it down against shoulder 154 in a sealing contact, the insert being hollow to provide the coolant passage therethrough. Here again, retention will be by radial plugs or other suitable means.

The seals are provided each to have a portion which lodges securely in one end of a connecting element and a second portion which inserts into a tapered complemental recess of another element under some axial compression to form a seal therewith when the drill elements are properly related axially for a driving action. Thus, an operator can readily insert the seals in one element and proceed to assemble. In addition, when the parts are disassembled, the sealing inserts will not dislodge and need not be replaced until this is warranted by wear.

In each case, it is important that axial pressure be exerted by the respective opposed shoulders or tapered sections to insure a tight coolant seal. This prevents wastage of coolant fluid as well as loss of pressure and provides a much drier work area as well as more efficient cutting.

I claim:

1. A sealant system for a mining drill system which includes a series of drilling and driving elements releasably connected end to end in driving engagement and having central passages to carry coolant water to a drilling area to cool the drilling tip and flush chips and dust away from the drilling tip which comprises:

(a) an elongate hollow driving element to be driven by a rotating power source, (b) a hollow drilling tip element to be driven by said driving element having a portion to be telescopically received in and driven by said driving element, (c) one or more hollow, elongate intermediate driving elements each having an end to telescopically and drivingly engage with an end of a driving element and an end of a drilling tip element and selectively with additional intermediate driving elements, (d) a sealing insert to seal the joints between each of said adjacent elements formed as a resilient, deformable, tubular nipple having a central passage therethrough comprising a first portion on one end to be received and retained in an axial recess of one of said elements, and a second projecting portion at the other end to be received in another of said adjacent elements in telescoping relation with said one element to seal the internal passages formed by said telescoping elements, one of said portions being enlarged circumferentially to be received in an enlarged recess in one of said elements to position the insert longitudinally, and (e) said enlarged recess in one of said adjacent elements comprising a second insert within the central bore of said one adjacent element having a cylindrical portion at one end lodged in a cylindrical recess in said adjacent element, and an enlarging recess at the other end to receive the projecting portion of the first insert.

2. A mining drill system as defined in claim 1 in which said central bore of said one adjacent element is dimensioned to provide radial clearance outside said enlarging recess to allow expansion upon insertion of said projecting portion of said first element.

* * * * *